US009808854B2

(12) United States Patent
Horn

(10) Patent No.: US 9,808,854 B2
(45) Date of Patent: Nov. 7, 2017

(54) DEVICE AND METHOD FOR AUTOMATICALLY TWISTING METAL WIRES, IN PARTICULAR FOR CONNECTING ADJACENT, PREFERABLY MUTUALLY INTERSECTING STRUCTURE ELEMENTS

(71) Applicant: Wobben Properties GmbH, Aurich (DE)

(72) Inventor: Gunther Horn, Aurich (DE)

(73) Assignee: WOBBEN PROPERTIES GMBH, Aurich (DE)

( * ) Notice: Subject to any disclaimer, the term of this patent is extended or adjusted under 35 U.S.C. 154(b) by 350 days.

(21) Appl. No.: 14/428,934

(22) PCT Filed: Jul. 25, 2013

(86) PCT No.: PCT/EP2013/065678

§ 371 (c)(1),
(2) Date: Mar. 17, 2015

(87) PCT Pub. No.: WO2014/044443

PCT Pub. Date: Mar. 27, 2014

(65) Prior Publication Data

US 2015/0266082 A1 Sep. 24, 2015

(30) Foreign Application Priority Data

Sep. 19, 2012 (DE) ..... 10 2012 216 831

(51) Int. Cl.
*B21F 15/04* (2006.01)
*E04G 21/12* (2006.01)

(52) U.S. Cl.
CPC ..... *B21F 15/04* (2013.01); *E04G 21/123* (2013.01)

(58) Field of Classification Search
CPC ..... B21F 15/02; B21F 15/04; E04G 21/122; E04G 21/123; B65B 13/185; B65B 13/28; B65B 27/10
(Continued)

(56) References Cited

U.S. PATENT DOCUMENTS 4,117,872 A 10/1978 Gott et al.
4,362,192 A 12/1982 Furlong et al.
(Continued)

FOREIGN PATENT DOCUMENTS

CN 87 1 03540 A 1/1988
CN 1826452 A 8/2006
(Continued)

*Primary Examiner* — Debra Sullivan
(74) *Attorney, Agent, or Firm* — Seed Intellectual Property Law Group LLP

(57) ABSTRACT

The invention concerns an apparatus, a method and a use of the apparatus for automatically twisting metal wires. The invention concerns in particular such an apparatus for connecting adjacent, preferably mutually crossing structural elements, comprising a wire feed means for feeding wire, preferably endless wire, into the apparatus, an arcuate wire guide which has a selectively openable and closable opening and which is adapted to guide the fed wire in the closed position along the arcuate wire guide from a first side of the arcuate wire guide to a second side of the arcuate wire guide, that is in opposite relationship with respect to the opening, a pulling slider adapted to engage the fed wire on the first side of the arcuate wire guide and to pull it towards the second side of the arcuate wire guide, and a twisting unit adapted to engage the fed wire on both sides of the arcuate wire guide and to twist it by means of a rotational movement.

18 Claims, 4 Drawing Sheets

(58) Field of Classification Search
USPC ..... 140/102.5, 117, 118
See application file for complete search history.

(56) References Cited

U.S. PATENT DOCUMENTS

| | | | |
|---|---|---|---|
| 4,508,030 | A | 4/1985 | Grenon |
| 4,685,493 | A | 8/1987 | Yuguchi |
| 4,834,148 | A | 5/1989 | Muguruma et al. |
| 4,842,025 | A | 6/1989 | Box et al. |
| 5,217,049 | A | 6/1993 | Forsyth |
| 5,431,196 | A | 7/1995 | Forrester, Jr. et al. |
| 5,505,504 | A | 4/1996 | Sato et al. |
| 5,657,799 | A | 8/1997 | Kusakari et al. |
| 5,947,166 | A | 9/1999 | Doyle et al. |
| 8,622,440 | B2 * | 1/2014 | Crichton ..... B65B 13/26 289/1.5 |
| 2011/0155277 | A1 | 6/2011 | Coles et al. |

FOREIGN PATENT DOCUMENTS

| | | | |
|---|---|---|---|
| CN | 201232363 | Y | 5/2009 |
| CN | 101586399 | A | 11/2009 |
| DE | 1 677 205 | | 6/1954 |
| DE | 1 066 486 | | 3/1960 |
| DE | 1 280 197 | B | 10/1968 |
| DE | 1 752 554 | A1 | 5/1971 |
| DE | 202 19 323 | U1 | 3/2003 |
| JP | 699926 | A | 4/1994 |
| JP | 2001527466 | A | 12/2001 |
| RU | 90097 | U1 | 8/2009 |
| RU | 2429100 | C2 | 11/2009 |
| SU | 625594 | A3 | 9/1978 |
| SU | 990386 | A1 | 1/1983 |
| WO | 92/06260 | A1 | 4/1992 |
| WO | 96/00135 | A1 | 1/1996 |
| WO | 2005/021893 | A1 | 3/2005 |
| WO | 2007042785 | A2 | 4/2007 |
| WO | 2012/047994 | A1 | 4/2012 |

* cited by examiner

DEVICE AND METHOD FOR AUTOMATICALLY TWISTING METAL WIRES, IN PARTICULAR FOR CONNECTING ADJACENT, PREFERABLY MUTUALLY INTERSECTING STRUCTURE ELEMENTS

BACKGROUND

Technical Field

The present invention concerns an apparatus for automatically twisting metal wires, in particular for connecting adjacent, preferably mutually crossing structural elements. The term structural element is used in the context of this invention to denote an elongate body of a round or polygonal, for example quadrangular cross-section. Examples of such structural elements are for example tubes, bars or carriers, as are used in many respects in all fields of industry. Stranded wire bundles, so-called stranded wire cables, or prestressing cables are also viewed as being embraced by the term structural element, being used inter alia for the production of reinforcing cages for prestressed concrete components.

Description of the Related Art

A typical area of use for apparatuses of the kind set forth in the opening part of this specification is the production of such reinforcing cages, for example for prestressed concrete elements. Reinforcing cages have a lattice-like structure comprising (steel) stranded wires. The lattice-like structure is achieved by stranded wires in a first direction and stranded wires in a second direction being arranged in mutually crossing-over relationship. In the region in which they cross each other, the so-called twisting region, the position of the stranded wires relative to each other is fixed by means of a metal wire. The metal wire is laid around the twisting region of the stranded wires, whereby a loop is formed. The two ends of the wire are then twisted relative to each other a plurality of times until the loop of the wire is sufficiently tight to fix the two mutually crossing stranded wires or generally the mutually crossing structural elements relative to each other.

Alternatively to a crossing-over arrangement of a plurality of structural elements, frequently generally adjacent structural elements are fixed by means of twisting wires around the adjacent structural elements. The procedure is implemented with the exception of the differing orientation of the structural elements, substantially as described hereinbefore.

As for example reinforcing cages comprise a large number of stranded wires and accordingly there is also a large number of twisting regions, very many wires have to be twisted for the production of reinforcing cage. Hitherto that has been effected exclusively as a manual operation. As the wires to be used for the twisting operation must also have a certain stability, that activity is exhausting for the persons performing that activity and is also very time-consuming. Because of the manual character of the twisting operation, this also involves irregularly twisted wires. That is admittedly not a serious consideration from the point of view of quality assurance, because of the large number of twistings performed, but a higher degree of reproduction accuracy when twisting wires over adjacent, preferably mutually crossing structural elements, would be desirable.

BRIEF SUMMARY

One or more embodiments are directed to an apparatus for automatically twisting metal wires, in particular for connecting adjacent, preferably mutually crossing structural elements, comprising a wire feed means for feeding wire, preferably endless wire, into the apparatus, an arcuate wire guide which has a selectively openable and closable opening and which is adapted to guide the fed wire in the closed position along the arcuate wire guide from a first side of the arcuate wire guide to a second side of the arcuate wire guide, that is in opposite relationship with respect to the opening, a pulling slider adapted to engage the fed wire on the first side of the arcuate wire guide and to pull it towards the second side of the arcuate wire guide, and a twisting unit adapted to engage the fed wire on both sides of the arcuate wire guide and to twist it by means of a rotational movement.

Advantageous configurations and preferred embodiments and configurations will be apparent from the appendant claims and the description hereinafter.

One or more embodiments of the invention makes use in particular of the realization that automation of the twisting operation makes a crucial contribution to operating in a less fatiguing fashion as in particular the twisting operation requires a great deal of effort.

One or more embodiments of the invention however also goes still further insofar as it provides an apparatus which also makes it possible for the wire to be passed around the twisting region of two or more adjacent, preferably mutually crossing structural elements, in an automated procedure, thereby significantly speeding up the entire working procedure. The interaction of automatedly passing the wire around the twisting region and the automated twisting operation is based on the following central notions: the wire is moved along an arcuate wire guide to ensure a high level of reproduction accuracy in terms of forming the loop by the wire. To be able to arrange the arcuate wire guide which is provided on the apparatus in such a way as to surround the twisting region, there is an opening in the arcuate wire guide. Even in the case of twisting regions which involve difficulties of access, as are to be found for example in relation to reinforcing cages for prestressed concrete components, that makes it possible to easily move the apparatus to the twisting region, engage around the twisting region with an opened arcuate wire guide, and to enclose the twisting region by closing the opening. The mode of operation is for example similar to a tongs arrangement. In addition one or more embodiments of the invention is distinguished in that the wire is pulled along the arcuate wire guide by the pulling slider. The configuration according to one embodiment of the invention of pulling guidance for the wire along the arcuate wire guide can be used for soft wires which permit better twisting than wires of hard material. The apparatus according to one embodiment of the invention, by opening and closing of the arcuate wire guide, makes it possible to place the arcuate wire guide around the twisting region of two structural elements, and the moveable pulling slider then makes it possible to pass the wire which has been fed on one side of the arcuate wire guide, with the arcuate wire guide closed, around the twisting region, along the arcuate wire guide. Finally the twisting unit can then engage the wire which has been passed around the twisting region by the pulling slider on both sides of the twisting region or on both sides of the arcuate wire guide and perform the twisting operation, for example by means of the rotational drive.

Preferably the arcuate wire guide is of a tongs-like configuration and the selectively openable and closable opening is arranged proximally on the apparatus. In this respect—relative to the operational orientation of the apparatus—the term "proximal" is used to mean the end of the apparatus, that is towards the structural elements to be connected.

An advantageous development of one embodiment of the invention provides that the twisting unit has a first wire guide passage hole and a second wire guide passage hole and wherein the wire feed means is adapted to pass the fed wire through the first wire guide passage hole. In that way, it is already possible, when feeding the wire in the direction of the arcuate wire guide, to prepare for later engagement of the wire by the twisting unit. The wire can already be engaged by the twisting unit, by being passed through the wire guide passage hole.

Further preferably the pulling slider is adapted to pass the wire pulled to the second side of the arcuate wire guide through the second wire guide passage hole in such a way that the wire forms a loop from the first to the second wire guide passage hole. What is advantageous with this embodiment is in particular preparation for engagement by the twisting unit on the second side of the arcuate wire guide in one working operation by means of the pulling slider when passing the wire along the arcuate wire guide. As soon as the loop is formed by the wire, it is also immediately passed into the second wire guide passage hole of the twisting unit and passed therethrough.

In a preferred embodiment the apparatus according to one embodiment of the invention has a clamping device which is preferably arranged on the first or the second side of the arcuate wire guide and which is adapted to hold fast the wire passed through the first wire guide passage hole or is adapted to hold fast the wire passed through the second wire guide passage hole. In particular the clamping device is adapted to move the wire after formation of the loop beyond the twisting region of the two structural elements so that twisting by the twisting unit can be further prepared.

Further preferably the apparatus according to one embodiment of the invention has a drive means for wire conveyance, wherein the drive means is adapted to convey the wire passed through the second wire guide passage hole and held fast by the clamping device, to shorten the formed loop to a predetermined size. When the engaged wire is twisted by means of the twisting unit the spacing between the constriction produced by the twisting effect and the structural elements to be twisted becomes less with each revolution. To achieve adequate fixing of the structural elements, a certain minimum number of twists is required. In order on the other hand to use as little wire as possible, the number of twists produced should not exceed a maximum amount. For that reason it is preferable for the spacing between the twisting unit and the structural elements to be limited and defined by reducing the size of the wire loop prior to the twisting operation. It has proven to be particularly preferable to set a loop length which leaves between the twisting unit and the structural elements, an internal spacing which corresponds to the pitch dimension between the first wire guide passage hole and the second wire guide passage hole.

That plane in which lie the points at which the wire is engaged by the twisting unit on the first and second sides of the arcuate wire guide is adopted as the reference point for the twisting unit, when determining the spacing. That plane is preferably perpendicular to the axis of rotation of the twisting unit.

Alternatively it is preferred that the drive means is associated with the wire feed means and is adapted to convey the wire selectively in the feed direction or in opposite relationship to the feed direction. The conveyor direction is primarily made dependent on which of the two sides of the arcuate wire guide the clamping is arranged and holds the wire fast.

In a further preferred configuration the drive means has a drive member which is motor-drivable and is coupled to the pulling slider in such a way that the pulling slider is displaceable selectively from the first side of the arcuate wire guide towards the second side of the arcuate wire guide and from the second side of the arcuate wire guide towards the first side of the arcuate wire guide.

In a further preferred embodiment the twisting unit has two coaxially arranged gears through which the first and second wire guide passage holes respectively completely extend and wherein the two gears are drivable both in opposite directions and also in the same direction. Preferably the two coaxially arranged gears are arranged in directly mutually adjacent relationship. Driving the two gears in opposite directions preferably causes clamping of the wire passed through the first and second wire guide passage holes. That makes it possible for the wire to be engaged by the twisting unit. The drive is preferably implemented by means of a respective servo motor.

As soon as adequate clamping of the wire has been achieved by driving the gears in opposite directions the two gears are preferably drivable in the same direction, more specifically in such a way that the clamping action is maintained while the gears rotate in synchronous relationship to bring about the twisting action by means of rotation of the two wire guide passage holes around a common axis of rotation.

Further preferably the apparatus according to one embodiment of the invention has a cutting body which is arranged to sever the wire within the apparatus and is adapted to sever the wire on the first side of the arcuate wire guide and/or on the second side of the arcuate wire guide. That additionally permits severing of the wire prior to twisting without having to carry separate tools with oneself. The apparatus according to one embodiment of the invention thus permits, in a single continuous working procedure, the feed of wire, passing the wire around an assembly of structural elements that is to be twisted, cutting the wire portion provided for the twisting operation from a wire portion at the feed side, and finally twisting the wire.

The cutting body is preferably in the form of a sharp-edged cutting edge within the apparatus, which is arranged adjacent to the wire passed through the apparatus. Preferably one or both of the gears of the twisting unit have the cutting edge or edges which is or are formed on the gear or gears in such a way that severing is effected when the twisting movement is initiated.

One or more embodiments of the invention further concerns a method of automatically twisting a metal wire for connecting two or more adjacent, preferably mutually crossing structural elements. In one embodiment the method includes the steps:

- providing two or more adjacent, preferably mutually crossing structural elements,
- feeding the wire into an apparatus according to one of the above-described preferred embodiments,
- passing a crossing region of the structural elements through an opened opening of an arcuate wire guide of the apparatus,
- closing the opening of the arcuate wire guide so that the crossing region of the structural elements is enclosed by the arcuate wire guide,
- engaging the fed wire by means of a pulling slider,
- pulling the fed wire by means of the pulling slider, with the arcuate wire guide closed, along the arcuate wire guide from a first side of the arcuate wire guide to a second side of the arcuate wire guide, that is in opposite relationship with respect to the opening, engaging the fed wire on both sides of the arcuate wire guide by means of a twisting unit, and twisting the engaged wire by means of a rotational movement of the twisting unit.

In regard to the underlying realization and advantages according to the invention attention is directed to the foregoing description relating to the apparatus according to the invention.

A preferable development of the method according to some embodiments of the invention provides that the step of engaging the fed wire by means of a twisting unit includes one or both of the steps:

passing the fed wire through a first wire guide passage hole, preferably by means of a wire feed means of the apparatus, and passing the wire which has been pulled to the second side of the arcuate wire guide in such a way that the wire forms a loop from the first to the second wire guide passage hole around the structural elements.

Further preferably the method includes the step:

holding fast the wire passed through the first wire guide passage hole or the wire passed through the second wire guide passage hole by means of a clamping device of the apparatus.

In a preferred development of the method it further includes the step:

conveying the wire passed through the second wire guide passage hole and held fast by the clamping device in such a way that the formed loop is reduced to a predetermined size.

Further preferably in the method according to one embodiment of the invention the step of engaging the fed wire on both sides of the arcuate wire guide by means of the twisting unit includes:

driving in opposite directions two coaxially arranged gears, through which the first and second wire guide passage holes respectively completely extend, in such a way that the wire passed therethrough is clamped, and wherein the step of twisting the engaged wire by means of rotational movement of the twisting unit includes:

driving in the same direction the two gears with the clamped wire.

Further preferably the method according to one embodiment of the invention includes the step:

severing the twisted wire on the first and/or on the second side of the arcuate wire guide by means of a cutting body within the apparatus.

One or more embodiments of the invention further concerns the use of an apparatus according to one of the above-described preferred embodiments for automatically twisting metal wires, in particular for connecting adjacent, preferably mutually crossing structural elements, for the production of a reinforcing cage for a pylon element of a wind power installation. The apparatus has in particular:

a wire feed means for feeding wire, preferably endless wire, into the apparatus, an arcuate wire guide which has a selectively openable and closable opening and which is adapted to guide the fed wire in the closed position along the arcuate wire guide from a first side of the arcuate wire guide to a second side of the arcuate wire guide, that is in opposite relationship with respect to the opening, a pulling slider adapted to engage the fed wire on the first side of the arcuate wire guide and to pull it towards the second side of the arcuate wire guide, and a twisting unit adapted to engage the fed wire on both sides of the arcuate wire guide and to twist it by means of a rotational movement. In this case the reinforcing cage as first and second structural elements has a plurality of first and second prestressing cables arranged in mutually crossing relationship. The prestressing cables can optionally be braided together, which facilitates positioning of the prestressing cables prior to twisting of the wire and enhances the stability of the cage.

The advantages of the foregoing developments and preferred embodiments of the apparatus according to the invention also apply to the developments and preferred embodiments of the method according to the invention and the development of the use according to the invention.

BRIEF DESCRIPTION OF THE SEVERAL VIEWS OF THE DRAWINGS

The invention is described in greater detail hereinafter by means of an embodiment by way of example and with reference to the accompanying Figures in which.

DETAILED DESCRIPTION

Figure 1:
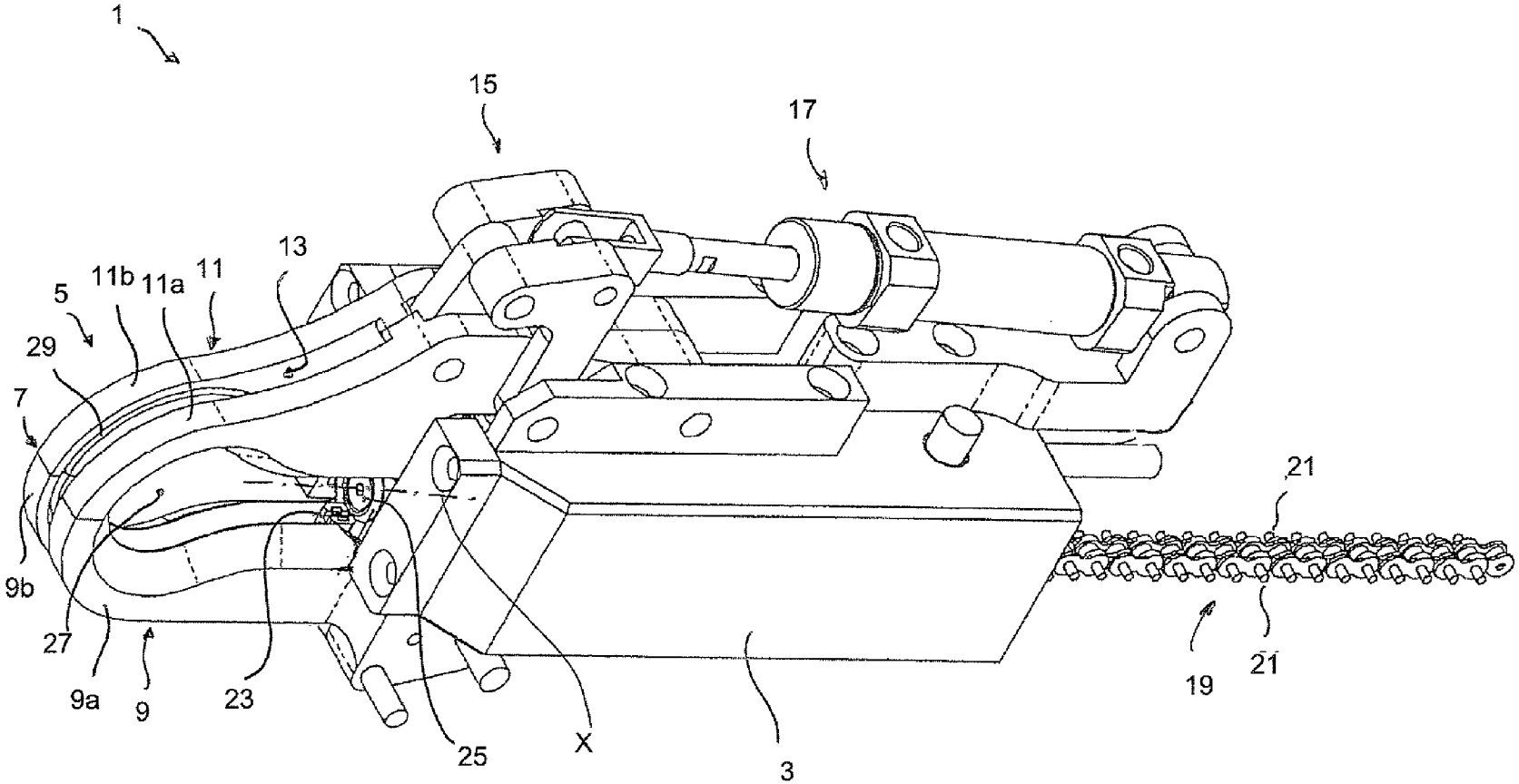
FIG. 1 shows a perspective view of an apparatus according to one embodiment of the invention for twisting metal wires.

FIG. 1 shows an apparatus 1 for automatically twisting metal wires. The apparatus 1 has a main body 3. Arranged on the main body 3 at a proximal end of the apparatus 1 is an arcuate wire guide 5. The arcuate wire guide 5 has a closable and openable opening 7 arranged substantially centrally between a first side 9 of the arcuate wire guide 5 and a second side 11 of the arcuate wire guide 5.

Figure 2:
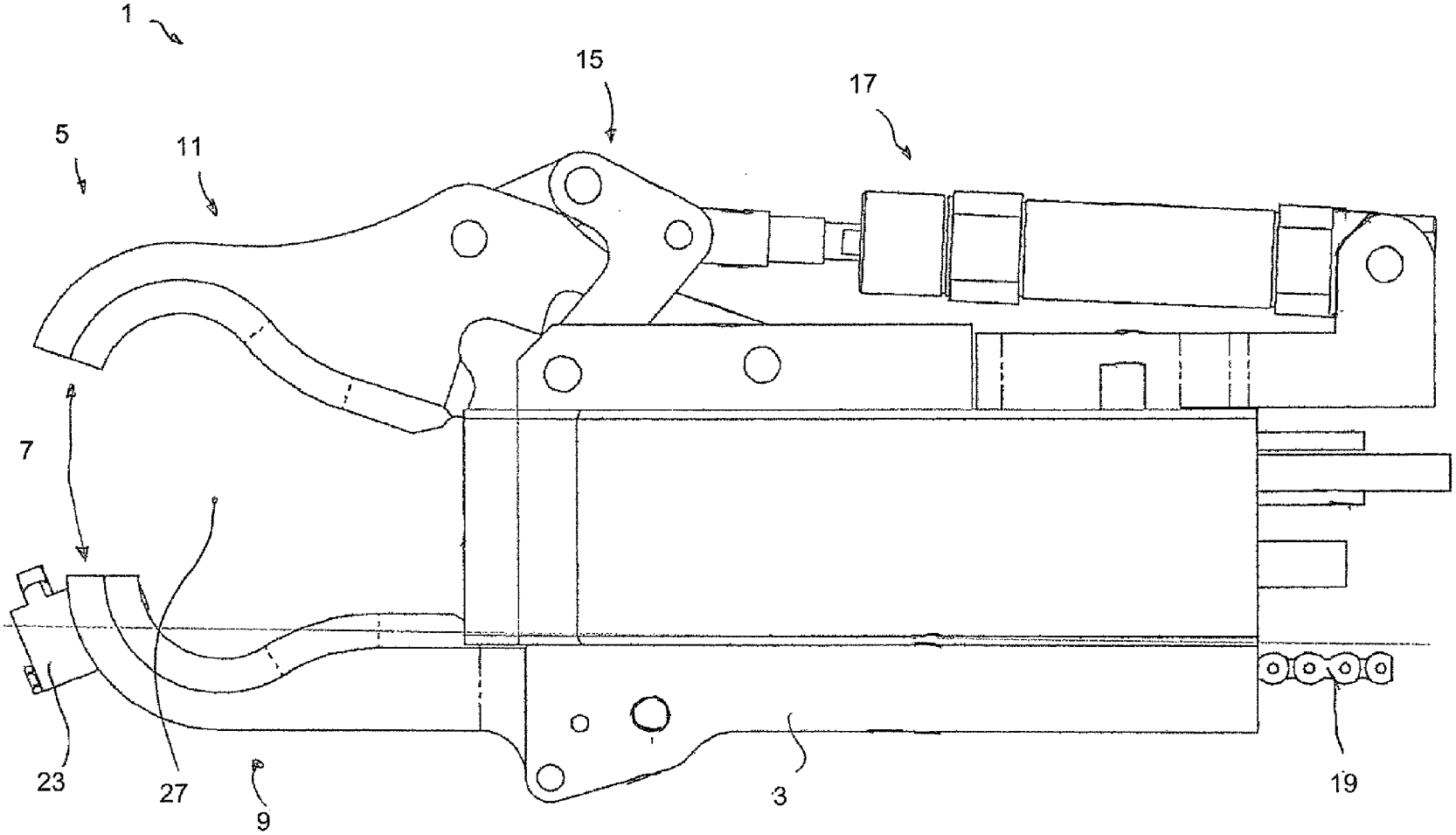
FIG. 2 shows a side view of the apparatus of FIG. 1 in another operating condition.

In the illustrated embodiment the first side 9 of the arcuate wire guide is arranged fixedly relative to the main body 3 while the second side 11 of the arcuate wire guide 5 can be deflected by means of a lever mechanism 15 in such a way that the opening 7 is moved from the closed position shown in FIG. 1 into an open position (FIG. 2). In the illustrated embodiment the lever mechanism 15 is driven by means of a pneumatic cylinder 17.

The arcuate wire guide 5 is of a substantially tongs-like configuration and in the interior of the two sides 9, 11 of the arcuate wire guide has a region 27 for receiving adjacent, preferably mutually crossing structural elements.

The arcuate wire guide 5 has a slot 13 extending substantially along the entire arc thereof. The slot 13 subdivides the first side 9 of the arcuate wire guide into two arc portions 9*a*, 9*b*. Similarly the slot 13 subdivides the second side 11 of the arcuate wire guide 5 into two arc portions 11*a*, 11*b*.

The slot 13 is adapted to receive a pulling slider 23 which is movable along the arcuate wire guide and which is guided by a guide groove 29 arranged internally in the arcuate wire guide.

A twisting unit 25 is arranged at an end of the region 27, that is opposite to the arcuate wire guide 5. The twisting unit 25 is adapted to receive and engage the wire guided along the arcuate wire guide 5, and is further adapted to twist it by rotation about an axis of rotation X.

Arranged at a distal end of the main body 3, that is opposite to the arcuate wire guide 5, is a drive chain 19 which extends partially out of the housing or main body 3 of the apparatus 1. The drive chain has a plurality of guide pins 21 adapted to stabilize and guide the drive chain 19 under a thrust loading.

In regard to the further Figures the same references are used for similar or identical elements. Accordingly, in regard to the description of those elements, in relation to each Figure reference is also directed to the other Figures. In the condition shown in FIG. 2 the arcuate wire guide 5 is moved by lateral pivotal movement of the second side 11 of the arcuate wire guide, into a position in which the opening 7 of the arcuate wire guide 5 is opened. The opening makes it possible to embrace two or more adjacent, preferably mutually crossing structural elements, for example two or more prestressing cables, in order to twist them.

In addition, in the operating condition shown in FIG. 2, the pulling slider 23 is a distance further along the first side 9 of the arcuate wire guide 5 in a direction towards the second side 11 of the arcuate wire guide 5.

Figure 3:
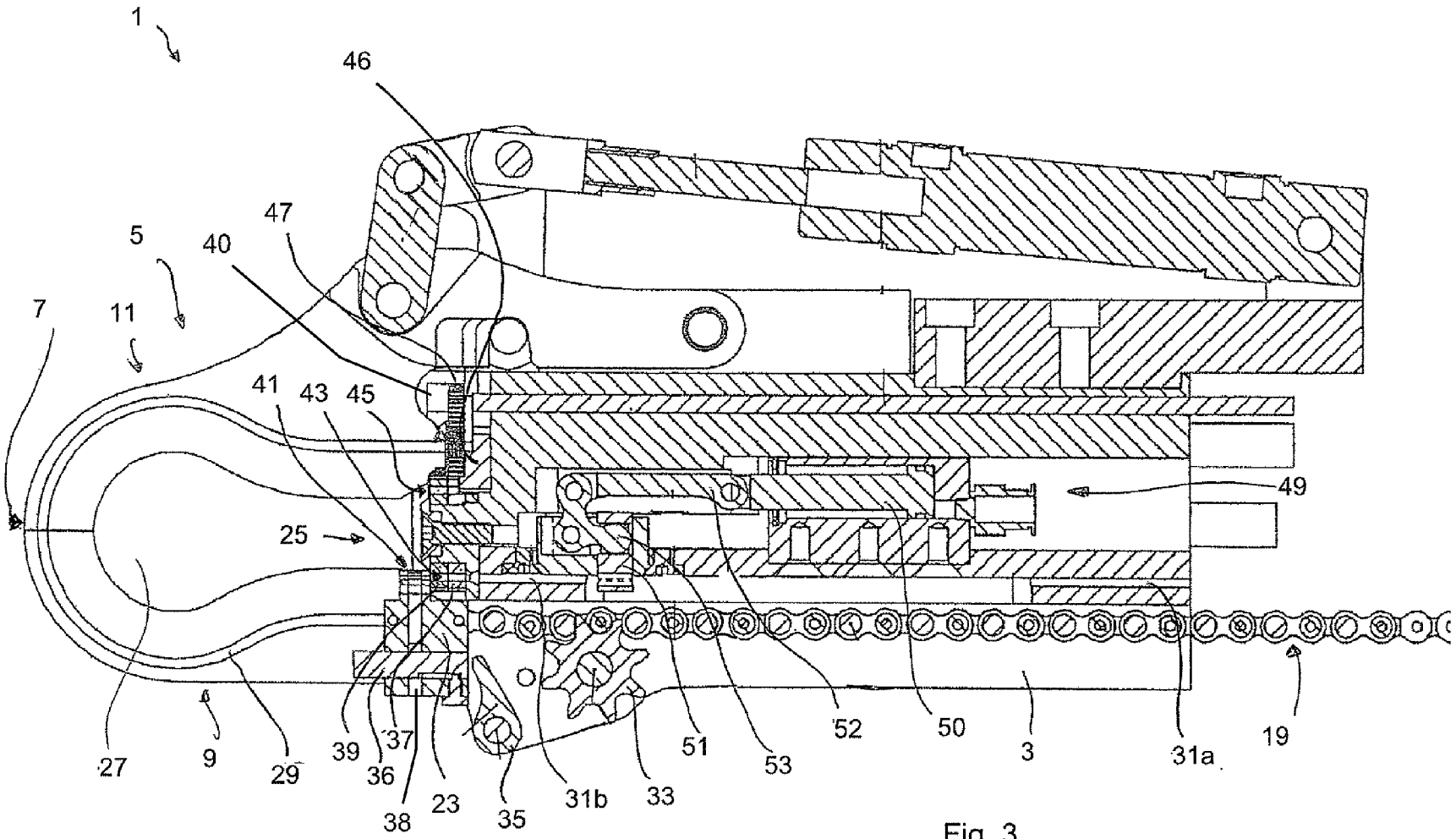
FIG. 3 shows a partly sectional side view of the apparatus of FIG. 1.

FIG. 3 permits a view on to the interior of the apparatus 1. The wire to be twisted is fed in a plurality of feed passages 31*a*, 31*b* by means of a drive means 49 in the direction of the arcuate wire guide 5. The drive means 49 has a piston 50 which deflects a first coupling member 52 and a second coupling member 53 in such a way that a clamping member 51, through which the wire is also passed, clamps the wire fast at the drive means 49. That makes it possible for the wire to be conveyed in the feed direction and in opposite relationship thereto.

The pulling slider 23 is coupled to the drive chain 19. The movement of the drive chain 19 in both drive directions is ensured by means of a drive pinion 33 arranged drivably on the main body 3 of the apparatus. By suitable driving of the drive chain 19, the pulling slider 23 is guided by means of the groove 29 and moved out of the position shown in FIG. 3 along the arcuate wire guide 5 on to the opposite second side 11 of the arcuate wire guide 5. That is preferably effected when the pulling slider 23 has engaged the fed wire in a clamping device 41 and has clamped it fast.

Figure 4:
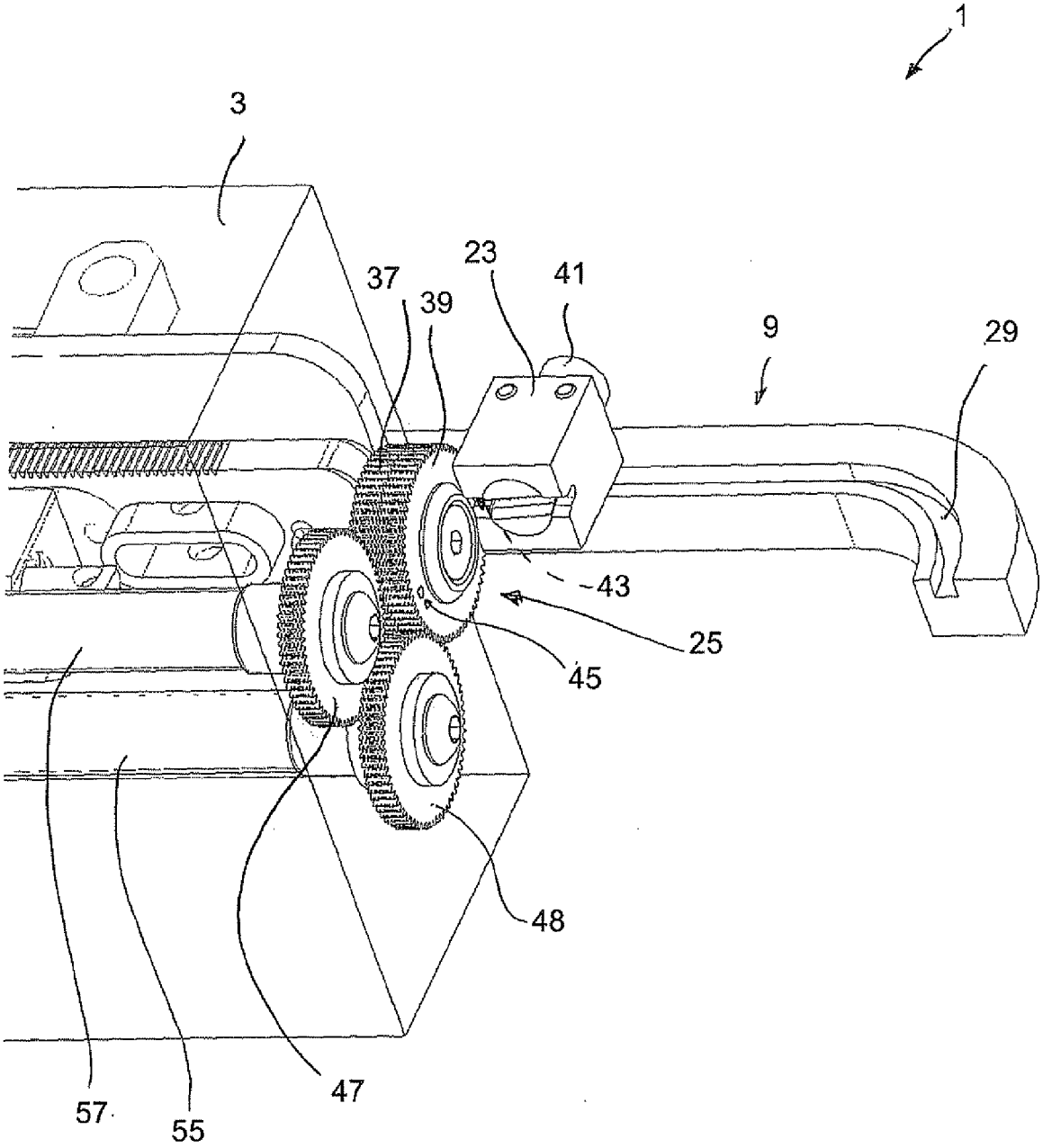
FIG. 4 shows a partly transparent perspective view of a portion of the apparatus of FIG. 1.

The twisting unit 25 (FIGS. 3 and 4) has two gears 37, 39 which are arranged coaxially with each other and directly adjacent to each other and through each of which a first wire guide passage hole 43 and a second wire guide passage hole 45 respectively completely extend. The first and second wire guide passage holes 43, 45 are preferably arranged in diametrally opposite relationship with respect to the axis of rotation of the two gears 37, 39 and are adapted to receive the wire. In the course of being fed by means of the drive means 49 the wire is passed through the first wire guide passage hole 43 on the first side of the arcuate wire guide 5 and passed by means of the pulling slider 23 on the second side 11 of the arcuate wire guide 5 through the second wire guide passage hole 45. In the passed-through condition (passed through the second wire guide passage hold 45) a second clamping device 46 is adapted to clamp the wire fast so that a reduction in the size of the loop can be effected by means of rearward conveying movement of the wire by the drive means 49, upon a movement back from the second side 11 of the arcuate wire guide 5 in the direction of the first side 9. The drive and further details of the twisting unit 25 are also shown in FIG. 4.

The clamping device 41 of the pulling slider 23 is preferably of such a configuration that a first slider member 36, for engagement and clamping of the wire by the pulling slider 23, upon deflection out of an open position, deflects a second slider member 38 which causes clamping of the wire. Coupling of the first slider member 36 to the second slider member is preferably implemented by means of two mutually adapted inclined planes which make it possible for the slider members 36, 38 to slide against each other and which define the direction of movement of the slider members.

The first slider member 36 is preferably arranged on the pulling slider and oriented in such a way that it is moved towards a step 40 upon movement of the pulling slider 23 from the first side towards the second side. The step 40 and the slider member 36 are firstly brought into contact with each other upon the approach of the pulling slider 23 to its end position on the second side. When the pulling slider 23 further approaches its end position on the second side the step 40 pushes against the slider member and displaces it from its relative position on the pulling slider 23 in the direction of its open position (shown in FIG. 3). That permits the wire to be transferred to the second clamping device and permits a return conveying movement of the pulling slider 23 without entraining wire. FIG. 4 shows the arrangement of the two gears 37, 39 relative to the pulling slider and the arcuate wire guide 9 as a perspective view. The first gear 37 of the twisting unit 25 is driven by means of a first gear 47. The second gear 39 of the twisting unit 25 is driven by means of a second gear 48. The gears 47 and 48 are connected by means of torsion shafts 55, 57 to a respective servo motor. The first gear 37 and the second gear 39 are drivable selectively in opposite directions or in the same direction by means of the gears 47, 48. The respective portions of the wire guide passage holes 43, 45 are slightly turned relative to each other by the gears 37, 39 being driven in opposite directions, and that leads to the wire which is passed through the wire guide passage holes 43, 45 being clamped fast. In the clamped-fast condition the motors are preferably actuated in such a way that the gears 37, 38 are driven in the same direction, in such a way that clamping of the wire is maintained.

Preferably the wire guide passage holes 43, 45 are in the form of slots, the slots extending along curved paths. Preferably the curved paths in the first gear 37 are not in coincident relationship with those in the second gear 47. Particularly preferably the curved paths are in the form of circular arcuate portions wherein the center points of the circles, that are associated with the arcuate portions, are arranged eccentrically in relation to the respective gears. That provides that the clamping is particularly gently built up upon relative movement of the gears with respect to each other as the wire guide passage holes in the form of slots are only gradually moved out of their coincident position with the portion of the wire guide passage hole, that is respectively associated with the other gear.

In a preferred embodiment the gears 37, 47 each have a plurality of sets of the wire guide passage holes. It is to be assumed that, in the course of time, wear occurs at the edges of the holes as a result of being acted upon by the clamping force. Gears with a plurality of sets of holes then have the advantage that there is no need for a complete change, but it is only necessary to "advance" the gears to the next set of holes.

FIG. 4 also shows a possible configuration of a clamping device 41 within the pulling slider 23. This is implemented as shown in Figure 4 by a rotatable pin which can narrow or close the through-passage for the fed wire.

With reference to FIGS. 1 to 4, set out hereinafter is a brief outline of the mode of operation of the apparatus 1 according to an embodiment of the invention. After two or more structural elements, for example prestressing cables, have been prepared, and arranged in mutually adjoining relationship, preferably in mutually crossing relationship, then, if fixing of the two structural elements in wanted in the region of the adjoining or mutually crossing relationship (hereinafter referred to as the twisting region), the apparatus 1 is moved closer to the twisting region. To embrace the twisting region of the two structural elements the second side 11 of the arcuate wire guide 5 is opened by actuation of the lever mechanism 15 so that the opening 7 is opened. The adjacent, preferably mutually crossing structural elements are introduced into the inner region 27 of the arcuate wire guide or the latter is passed tongs-like around them.

To prepare for a loop-forming operation the wire is fed in the direction of the pulling slider 23 either manually or by means of a drive device like for example the drive means 49. The wire is engaged by the pulling slider 23 by means of a clamping device 41 and passed from the first side 9 of the arcuate wire guide 5 in the direction of the second side 11 thereof. Optionally, the pulling slider 23 is already partially displaced along the first side 9 of the arcuate wire guide 5 before the arcuate wire guide 5 has become placed completely around the structural elements and the opening 7 is closed again. With the opening 7 closed, the pulling slider 23 is moved completely on to the second side 11 of the arcuate wire guide, where the wire engaged by the pulling slider 23 is transferred to the second wire guide passage hole 45 of the twisting unit 25. In the operation of feeding the wire, the wire has already also been previously passed through the first wire guide passage hole 43 of the twisting unit 25.

Then the wire which forms a loop is clamped fast by means of a wire clamp 46. The pulling slider 23 is released from the wire and moves partly or completely back into its original position again on the first side of the arcuate wire guide 5 (for example as shown in FIG. 1).

Before the twisting unit 25 twists the wire by rotation of the two wire guide passage holes 43, 45 around each other, the length of the wire loop formed is preferably shortened to a predetermined dimension dependent on the spacing of the two wire guide passage holes 43, 45 and the required minimum loop length which in turn depends on the thickness of the structural elements.

Shortening of the loop is preferably effected by means of the drive means 49 or by means of again engaging the wire by the pulling slider 23 when the latter has not yet moved completely back into its position on the first side 9 of the arcuate wire guide 5 (FIG. 1), followed by subsequent return movement by means of the pulling slider.

When the loop has reached its predetermined length the gears 37, 39 are firstly driven in opposite directions by means of the gears 47, 48 and the motors connected thereto until sufficient clamping is achieved within the twisting unit 25. In that clamped condition the gears 37, 39 are then driven in the same direction and the wire is severed within the apparatus 1, preferably by means of a cutting body, for example by means of one or more cutting edges on the gears. The twisting unit 25 performs a twisting movement about the axis X subsequently to the severing operation. After the desired number of revolutions the opening 7 is opened again and the apparatus 1 is removed from the twisting region in order for example to perform a subsequent twisting operation.

As will be apparent from the foregoing description the entire procedure in forming the loop and twisting the structural elements is effected in fully automated fashion, which represents significantly easier work for operators.

The invention claimed is:

1. An apparatus for twisting metal wires for connecting adjacent or mutually crossing structural elements, the apparatus comprising:

a wire feed means for feeding wire into the apparatus, an arcuate wire guide that has a selectively openable and closable opening and is adapted to guide the fed wire when in the closed position along the arcuate wire guide from a first side of the arcuate wire guide to a second side of the arcuate wire guide, wherein the first and second sides of the arcuate wire guide are in opposite relationship with respect to the opening, a pulling slider adapted to engage the fed wire on the first side of the arcuate wire guide and to pull the fed wire towards the second side of the arcuate wire guide, and a twisting unit adapted to engage the fed wire on both the first and second sides of the arcuate wire guide and to twist the fed wire by a rotational movement.

2. An apparatus according to claim 1 wherein the first and second sides of the arcuate wire guide separate from each other to open the opening and come together to close the opening, and wherein the opening is arranged at a proximal end of the apparatus.

3. An apparatus according to claim 1 wherein the twisting unit has a first wire guide passage hole and a second wire guide passage hole and wherein the wire feed means is adapted to pass the fed wire through the first wire guide passage hole.

4. An apparatus according to claim 3 wherein the pulling slider is adapted to pass the wire pulled to the second side of the arcuate wire guide through the second wire guide passage hole in such a way that the wire forms a loop from the first wire guide passage hole to the second wire guide passage hole.

5. An apparatus according to claim 3 comprising a clamping device arranged on the first or the second side of the arcuate wire guide and adapted to hold the wire passed through the first wire guide passage hole or to hold the wire passed through the second wire guide passage hole.

6. An apparatus according to claim 5 comprising a drive means for conveying the wire, wherein the drive means is adapted to convey the wire passed through the second wire guide passage hole and held by the clamping device to shorten a loop that has formed to a predetermined size.

7. An apparatus according to claim 6 wherein the drive means is associated with the wire feed means and is adapted to convey the wire selectively into the apparatus in a feed direction or in an opposite direction.

8. An apparatus according to claim 6 wherein the drive means includes a drive member that is motor-drivable and is coupled to the pulling slider in such a way that the pulling slider is displaceable selectively from the first side of the arcuate wire guide towards the second side of the arcuate wire guide and from the second side of the arcuate wire guide towards the first side of the arcuate wire guide.

9. An apparatus according to claim 1 wherein the twisting unit has two coaxially arranged gears through which first and second wire guide passage holes completely extend, and wherein the two coaxially arranged gears are drivable both in opposite directions and in a same direction.

10. An apparatus according to claim 1 comprising a cutting body configured to sever the wire within the apparatus and adapted to sever the wire on at least one of the first side of the arcuate wire guide and on the second side of the arcuate wire guide.

11. A method of twisting a metal wire for connecting two or more adjacent or mutually crossing structural elements, the method comprising the steps:

providing two adjacent or mutually crossing structural elements, feeding the wire into an apparatus according to claim 1, passing a crossing region of the structural elements through the opened opening of the arcuate wire guide of the apparatus, closing the opening of the arcuate wire guide so that the crossing region of the structural elements is enclosed by the arcuate wire guide, engaging the fed wire by the pulling slider, while the arcuate wire guide is in the closed position, pulling the fed wire by the pulling slider along the arcuate wire guide from the first side of the arcuate wire guide to the second side of the arcuate wire guide, engaging the fed wire on both the first and second sides of the arcuate wire guide by a twisting unit, and twisting the engaged wire by a rotational movement of the twisting unit.

12. A method according to claim 11 wherein the step of engaging the fed wire by a twisting unit includes at least one of the following steps:

passing the fed wire through a first wire guide passage hole, and passing the wire that has been pulled to the second side of the arcuate wire guide in such a way that the wire forms a loop from the first wire guide passage hole to a second wire guide passage hole around the structural elements.

13. A method according to claim 12 including:

holding the wire passed through the first wire guide passage hole or the wire passed through the second wire guide passage hole.

14. A method according to claim 13 including:

conveying the wire passed through the second wire guide passage hole and held by a clamping device in such a way that the formed loop is reduced to a predetermined size.

15. The method according to claim 12, wherein passing the fed wire through the first wire guide passage hole comprises using the wire feed means of the apparatus to pass the fed wire through the first wire guide passage hole.

16. A method according to claim 11 wherein the step of engaging the fed wire on both sides of the arcuate wire guide by the twisting unit includes:

driving in opposite directions two coaxially arranged gears, both of the gears including first and second wire guide passage holes such that the wire is passed through the first and second wire guide passage holes and is clamped, and wherein the step of twisting the engaged wire by rotational movement of the twisting unit includes:

driving the two gears in a same direction with the clamped wire.

17. A method according to claim 11 including the step:

prior to the twisting step, severing the wire on at least one of the first and second sides of the arcuate wire guide by a cutting body within the apparatus.

18. A method of using an apparatus for automatically twisting metal wires for connecting adjacent or mutually crossing structural elements for the production of a reinforcing cage for a pylon element of a wind power installation, wherein the apparatus is an apparatus in accordance to claim 1, the method comprising:

feeding wire into the wire feed means, placing the opening of the arcuate wire guide in an open position, placing the adjacent structural elements or the mutually crossing structural elements in the opening, placing the opening in a closed position to surround the structural elements or the mutually crossing structural elements, engaging the fed wire by the pulling slider at the first side of the arcuate wire guide, using the pulling slider, pulling the fed wire towards the second side of the arcuate wire guide, and twisting the wire fed on both sides of the arcuate wire guide by rotational movement of the twisting unit, and wherein the reinforcing cage has first structural elements that includes a plurality of first and second prestressing cables arranged in mutually crossing relationship.

* * * * *